US008390661B2

(12) United States Patent
Waidman et al.

(10) Patent No.: US 8,390,661 B2
(45) Date of Patent: Mar. 5, 2013

(54) PRINTER, PRINTING METHOD AND PRINTER CALIBRATION METHOD

(75) Inventors: Ran Waidman, Rehovot (IL); Eyal Shelef, Tel-Aviv (IL); Shlomo Harush, Nes-Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 897 days.

(21) Appl. No.: 12/237,785

(22) Filed: Sep. 25, 2008

(65) Prior Publication Data

US 2010/0074639 A1 Mar. 25, 2010

(51) Int. Cl.
*B41J 2/435* (2006.01)
*B41J 2/47* (2006.01)

(52) U.S. Cl. ..... 347/236; 347/246; 347/240; 347/251; 347/253

(58) Field of Classification Search ..... 347/236, 347/240, 246, 251, 253
See application file for complete search history.

(56) References Cited

U.S. PATENT DOCUMENTS

| | | | | |
|---|---|---|---|---|
| 5,323,179 | A * | 6/1994 | Sanger et al. | 347/237 |
| 6,072,512 | A * | 6/2000 | Fukasawa | 347/131 |
| 6,101,271 | A * | 8/2000 | Yamashita et al. | 382/167 |
| 6,349,185 | B1 | 2/2002 | Burkes et al. | |
| 7,061,648 | B2 * | 6/2006 | Nakajima et al. | 358/1.9 |
| 2003/0217662 | A1 | 11/2003 | Koifman et al. | |
| 2006/0215010 | A1 * | 9/2006 | Ohki et al. | 347/251 |

FOREIGN PATENT DOCUMENTS

WO WO-2005/043888 5/2005

* cited by examiner

*Primary Examiner* — Stephen Meier
*Assistant Examiner* — Sarah Al Hashimi

(57) ABSTRACT

A method of calibrating an electrophotographic printer (30), the printer configured with a plurality of light settings, each light setting arranged to produce a different element type, the method comprising: determining (S10) a first light level required to print a first element type by applying a proportional change to a first initial light setting; and determining (S30) a second light level required to print a second element type by applying substantially the same proportional change to a second initial light setting.

11 Claims, 7 Drawing Sheets

PRINTER, PRINTING METHOD AND PRINTER CALIBRATION METHOD

This invention relates to a printer, to a method of printing and a method of calibrating a printer.

An electrophotograhic printer (also commonly termed "xerographic printer") uses light to scan a digitized image onto a photoconductor. Types of electrophotographic printers include dry toner laser printers, liquid electrophotographic (LEP) laser printers and LED printers (to name only some printers). The discussion and disclosure in this patent specification relating to laser printers also applies to electrophotographic printers in general.

Electrophotographic printers generally use a discharge area development (DAD) electrophotographic process in which light is used to selectively discharge electrical charge on a photoconductor to form a latent electrostatic image. The photoconductor typically comprises a belt or drum coated with a photosensitive material. The photoconductor is capable of retaining localised electrical charge with each localised area capable of receiving charge corresponding to a pixel. In this way the photoconductor can selectively attract toner depending on the charge present or not present on each area of the photoconductor. The adhered toner or ink is then transferred to a print medium such as paper and fused onto the print medium so as to produce the required image.

Electrophotographic printers (as well as other types of printer) exhibit dot gain which is the increase in dot size on the print medium in comparison with the digital (commanded) dot size. Dot gain occurs because of the ink's ability to spread through the print medium as it is soaked into the medium. The dot gain is generally dependent on the type of print medium, solid ink density, ink characteristics (for example ink viscosity), screen frequency/geometry and print machine characteristics such as plate to blanket pressure or blanket characteristics. Dot gain will therefore generally vary depending on the type and model of printer and even between different printers of the same model. Additionally, dot gain can shift over time/number of prints for the same printer due to drift in the state of the printer.

The level of dot gain in an image formed using an electrophotographic process is also dependent on the way in which the light source acts on the photoconductor surface to form the latent image. The extent to which light from the light source changes the charge distribution on the photoconductive surface affects the amount of toner or liquid ink (or other pigmenting/marking material) which will adhere to the surface and therefore affects the level of dot gain.

In this specification the "light level" is used to indicate how light from the light source acts on the photoconductive surface. As discussed, this is related to the extent of change in the charge distribution on the photoconductor surface in regions where the light strikes and thus the amount of toner/ink which will adhere to the surface and is thus linked to the level of dot gain. Variation in the light level received at the photoconductive surface can be achieved by, for example, operating the light source in different modes (eg power modes or scanning modes) for different periods of time, by operating the light source in bursts, by operating the light source at different intensity/power levels or by causing different amounts of light to act upon the surface in any other suitable way. If the light source is a laser, one way of achieving a variation in the light level is by laser power modulation or by laser pulse width modulation.

To achieve or maintain print quality a calibration should generally be performed for the particular set of print conditions (medium type, ink type, printer type/set up etc) that is going to be use to produced the required printed output. In this way the laser intensity of a laser printer (or, more generally, the light intensity of an electrophotographic printer) can be controlled to achieve a desired dot area of the printed pixel. Good control of dot gain is particularly important for the commercial packaging market. Companies often rely on consumers recognizing the colours on their packaging and do not wish different batches to have different colors. Additionally, exact colors on packaging act as a barrier to product piracy and forgery.

Types of print element that can be printed include, for example, single pixels, or print elements that form part of a text edge or a barcode or as part of a halftone image. To achieve good printing quality, different print elements require pixels with dots of a particular dot area. This can be accomplished by controlling a laser printer so as to operate at different laser levels according to the type of print element that is being printed. Since laser based printing can use varying laser levels (depending on the type of elements that are printed), separate calibrations for each laser level have generally been recommended in order to get the best print quality and consistency over time. Such an approach is time consuming and is wasteful of ink and substrate. In some cases the user may forgo at least some of the calibrations in order to save time (or to reduce the costs associated with ink and substrate consumption) and thereby reducing the quality of the printed outputs. As one example, for the Hewlett-Packard 5500 press sixteen different laser intensities can be used to print different elements in this press (text edge, single pixel, half toning, etc). Six types of calibration are often performed in order to 'calibrate' this press—some of the laser intensities are calibrated whilst the calibration of the other laser intensities is ignored. That is, rather than spending excessive time, ink and substrate calibrating all the possible laser intensities the operator forgoes some of the calibrations. In this way quality is compromised for the sake of efficiency.

Aspects and embodiments of the invention are set out in the appended claims.

An embodiment of the invention provides a method of operating an electrophotographic printer, the printer being operable to use a plurality of light intensities to produce a plurality of different print elements, the method comprising: applying a calibration factor to a first light intensity to produce a first desired print element; and calibrating other light intensities, used for producing other print elements, using said calibration factor.

For the purposes of this specification the term "intensity" is taken to be the optical power per unit area of the illumination. Therefore, if the area of illumination is kept constant then the intensity of the light will scale linearly with the power of the light and changing the optical power of an electrophotographic printer will be analogous to changing the optical intensity of the printer. Embodiments of the invention described in terms of calibrating the light intensity of a printer can also be realised by calibrating the output of the light source in other ways so as to control the light level. For example, instead of (or as well as) controlling the light intensity/power, the exposure time of the light may be controlled.

Embodiments of the invention will now be described by way of example with reference to the accompanying drawings.

Figure 1:
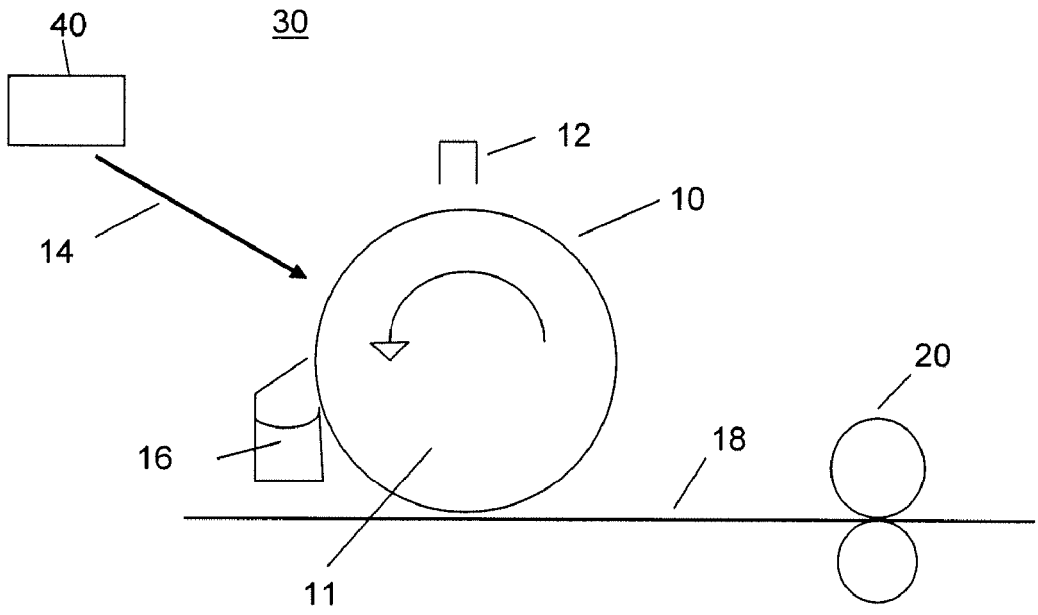
FIG. 1 shows a schematic representation of an electrophotographic printer according to an embodiment of the invention.

Referring to FIG. 1, a printer 30 is illustrated as an aid to understand embodiments of the invention. The printer 30 could in fact take many different forms, for example, the printer may have additional, different or fewer components than the printer illustrated. The printer 30 illustrated comprises a photoconductor 10 that generally forms the outer surface of a rotatable cylindrical drum 11. During the printing process the surface of the photoconductor 10 is uniformly charged with static electricity by, for example, a corona discharge 12. Portions of the photoconductor 10 are exposed with light 14 from a light source 40. As the drum 11 is rotated, the light 14 discharges the charge on the drum in exposed areas and leaves a charged latent image. The latent image is then developed by applying a toner 16, such as a liquid ink toner (e.g. as in LEP printing) or a pigmented dry powder toner, over the surface of the photoconductor 10. The toner 16 adheres to the discharged areas of the photoconductor 10 so that the latent image becomes visible. The toner 16 is then transferred from the photoconductor 10 to a sheet of paper 18 or to some other medium which is to support the printed image. A fuser 20 may be used to fix the image to the paper 18 by applying heat and pressure, or pressure alone, to the toner 16 on the paper 18. The direct-to-paper transfer system shown in FIG. 1 represents only a subset of electrophotographic printers. Many electrophotographic printers use an intermediate transfer member (ITM) such as a drum, belt or blanket to receive the toner image from the photoconductor 10 and apply it to the print medium. Some printers have no separate fuser, and the fusing process occurs during the transfer from the intermediate transfer drum to the paper.

The printer can operate under a range of different parameters that may or may not be measured. These parameters may include (but are not limited to) ink density, ink conductivity, ink temperature, ink separation, imaging oil temperature, imaging oil dirtiness, ITM temperature, and ITM blanket counter (a measure of blanket age or usage, such as a number of impressions made by the blanket since the blanket was installed), corona voltage, and developer voltage. Some of these parameters may be used to control the output produced by the printer.

The printer can operate under a range of different laser intensities to produce different types of print element. Examples of print element type are (but are not limited to):

1: The 100% regular Solid. (LP=15)

½: is used in 800 dpi for thinning, for example edge pixels (as may be used in an edge of letters of text of small font size). (DEFAULT=36%)

1 Protect: is used in 800 dpi as a stand alone line. (DEFAULT=75%)

1 Prime: is used in 1200 dpi as a stand alone or edge line. (DEFAULT=110%)

SD, ⅓ SD, ⅔ SD—are all calibrated by the single dot control feature and not relevant to the line work calibration.

⅓ and ⅔: used in 1200 dpi and 600 dpi, used to print a single line with the same width as 1' but shifted from the 800 dpi grid by ±⅓ grid spacing (2400 dpi grid) (DEFAULT=28, 44).

⅓ s and ⅔ s (supported): same as ⅓ ⅔ calibration but when the edge pixel is "supported" on a 1 pixel.

For the above examples the laser power (LP) is expressed in arbitrary units with LP=15 defined as the laser power for a regular solid and the laser power required for the other elements being expressed as a percentage value of LP=15.

Figure 2:
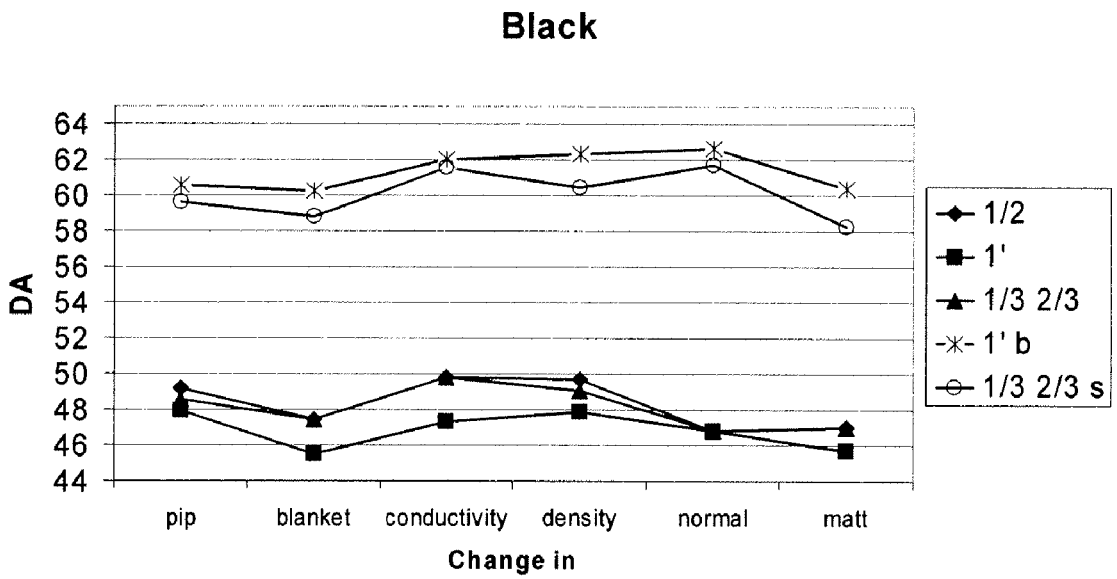
FIG. 2 is a graph, for a printer according to an embodiment of the invention, illustrating the variation in the dot area of a print element under different print conditions for five different types of print element, wherein the print elements are printed using a black ink.

Referring to the graph of FIG. 2 six different print parameters (machine states) are illustrated along the x-axis. These parameters relate to, respectively, changes to the Photo Imaging Plate (PIP), blanket, ink conductivity, ink density and whether the print medium has a normal or matt finish. All of these parameters affect the dot gain and hence a change in any one of these parameters will change the dot area (DA) of the printed dot. The label on the x-axis indicates which of the parameters was changed with all the other parameters remaining substantially unchanged.

To obtain the data illustrated in FIG. 2, a calibration was performed to find an adjustment factor to the laser intensity so that the required dot area was obtained for a particular type of print element for each of the different machine states. That is, a set of adjustment factors, relating to the various machine states, is obtained for one particular type of print element. These adjustment factors were then applied to obtain the required light intensities for printing the other types of print element. That is, only one of the laser intensities for one of the print elements was calibrated and the remaining laser intensities used for the other print elements were predicted using that calibrated laser intensity.

The five different plots of FIG. 2 each represent a different printed element produced at a different laser intensity (the plots are labelled: ½; 1';⅓ ⅔; 1' b; and ⅓ ⅔ s). For the particular results shown in FIG. 2 the laser intensity was calibrated for the print element labelled "½" and the laser intensities required for printing the other print elements were derived from this calibrated intensity. The ½ laser intensity pattern was chosen as the laser intensity to be calibrated because it showed the most variation in dot area for different printer states, i.e. it was the most sensitive type of print element.

The calibration determines an adjustment factor that needs to be applied to the initial laser intensity setting to provide the laser intensity required for printing a particular print element type with the correct dot area. This adjustment factor can then be applied to the laser intensity settings that would have been used for the other types of print element so that those print elements can be printed using the correct dot area. In this way the calibration makes a proportional change to the initial light level setting for printing a particular element type and the same proportional change is made to the other initial light levels settings for printing the other element types. FIG. 2 shows the results for measurements of dot area (shown as DA on the y axis) when the calibration factor was applied to each of five different print elements across a range of print parameters/machine states.

It can be seen from the results illustrated in FIG. 2 that the dot area of each of the different types of print elements is relatively constant despite the laser intensities for each of the different types of print elements having not been calibrated separately. Therefore, contrary to expectation, good print quality can be obtained for a particular machine state when a calibration is performed at a single laser intensity (for a particular print element type) with the other laser intensities required for the other element types being obtained by applying the same calibration factor. By measuring the dot area of the print element, for a particular machine state, and comparing it to the required dot area for that print element an adjustment factor can be applied to the laser intensity so that the correct dot area for future prints can be obtained. This adjustment factor can then be applied to the other laser intensities that would have been used to print the other print element. If the machine state changes (eg when the ink is changed) then a new calibration can be run to obtain a new adjustment factor but again this calibration need only be run for a single print element type with the laser intensities required for other print element types being calculated with the new adjustment factor.

Figure 3:
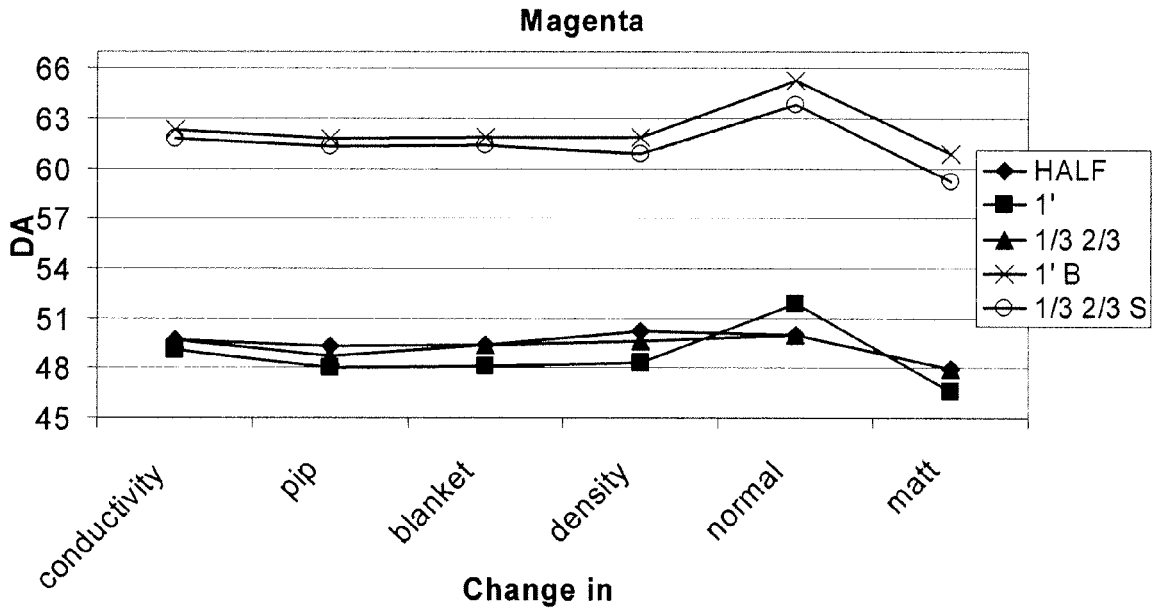
FIG. 3 is a graph, for a printer according to an embodiment of the invention, illustrating the variation in the dot area of a print element under different print conditions for five different types of print element, wherein the print elements are printed using a magenta ink.

FIG. 3 illustrates a graph having five plots which correspond to the same print elements as used in FIG. 2. For this graph the dot area of the printed output was measured when the printer was operated with a magenta ink. As with the experiment used to generate the graph of FIG. 2, only one of the laser intensities was calibrated and this calibrated intensity was used to calibrate the laser intensities for the other types of print element. The results once more show that the dot area remains fairly constant across the range of machine states used.

Figure 4:
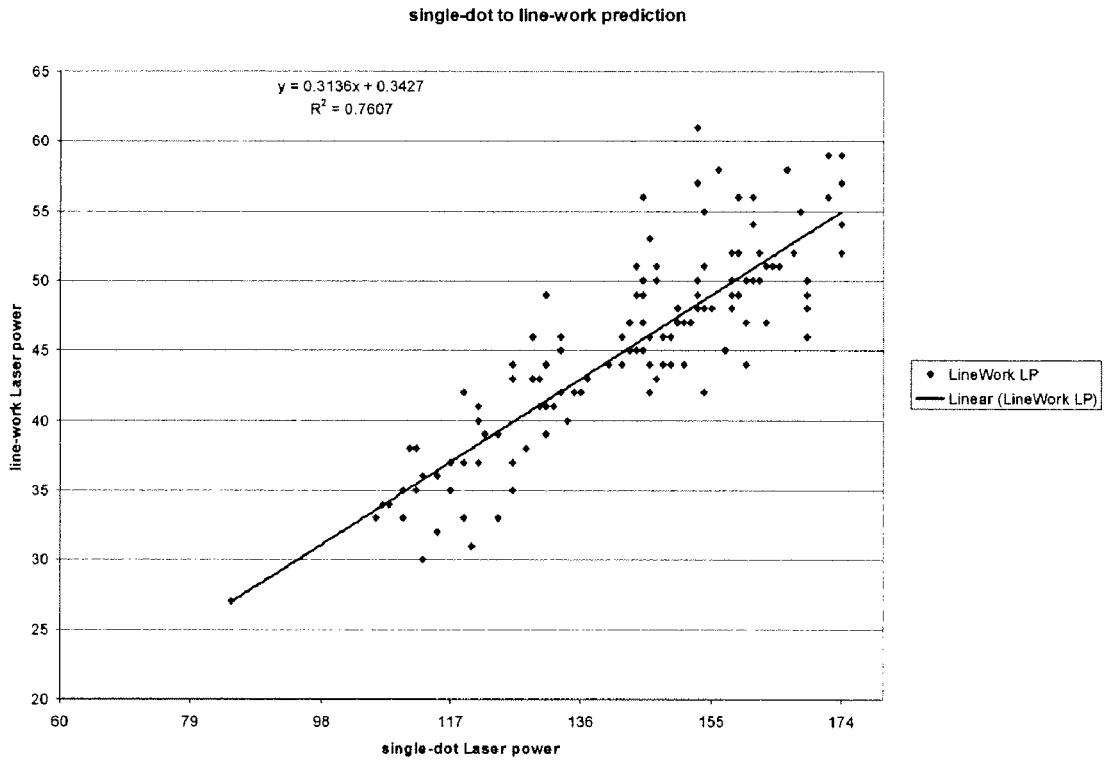
FIG. 4 is a graph, for a printer according to an embodiment of the invention, of the laser intensity required to print a line element versus the laser intensity required to print a single dot element using different printers and/or different printing conditions.

In another experiment the laser intensity required to print a single dot element at a required dot area and the laser power required to print a line element at a required dot area were measured across a wide range of printers and printer states. The results are shown in FIG. 4 which is a graph of the laser intensity required to produce a print element that forms part of a line (labelled "line-work") against the laser intensity required to produce a print element that is a single dot ("labelled as single-dot"). Each point on the graph represents the laser intensity required when a different printer and/or print machine state is used to produce the printed output. The graph shows that there is a correlation between the laser intensity required to print a particular element type (eg a single dot element) with the laser intensity required to print a different element type (eg a line element). For example, if the laser intensity required to print a single dot element was calibrated for a particular printer/print machine state then this correlation can be used to provide the laser power required for, say, a line element. That is, the laser intensity for the line element would not need to be calibrated. For the particular results illustrated in FIG. 4 the relationship between the laser intensity required for a line element "y" and the laser intensity required for a single dot element "x" is $y=0.3136x+0.3427$ with a coefficient of regression of $R^2=0.7607$.

Figure 8:
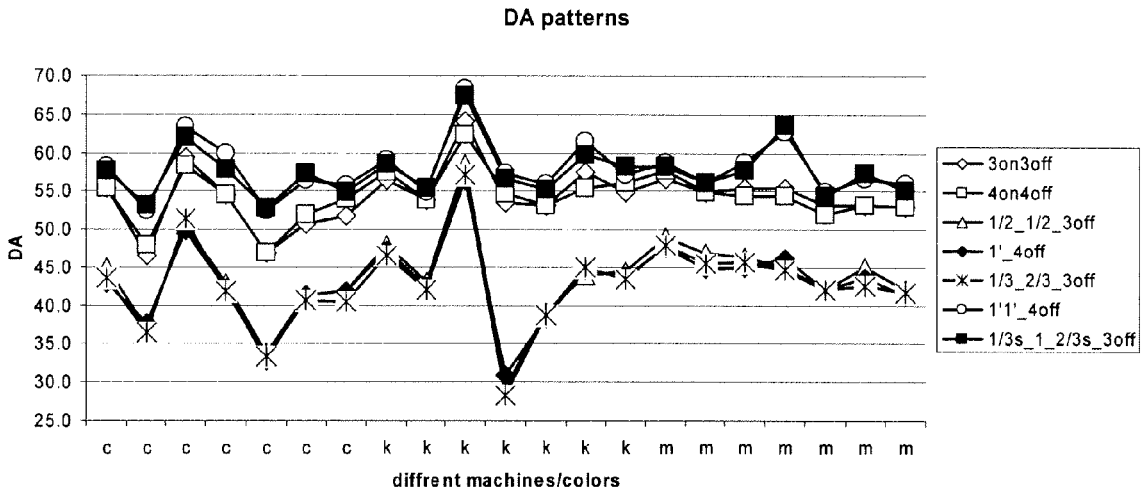
FIG. 8 is a graph, for a printer when the printer is operated without calibrating the light intensity.

In contrast to the results illustrated in FIGS. 2 and 3, FIG. 8 is a graph obtained by operating the printer without calibrating the laser intensities. The graph consists of seven plots with each plot corresponding to dot area measurements made for a different type of print element. Each plot comprises data points obtained by measuring the dot area for a particular element type when that element type is printed using several different printers and using three different ink colours. In FIG. 8 the labels "c", "k" and "m" respectively correspond to cyan, black and magenta coloured ink. Each label appears seven times because seven different printers were used. It can be seen from FIG. 8 that there is a wide variation in the dot area for a particular element as the printer and/or ink colour is changed when the light intensity is not calibrated. It can also be seen that the plots follow a similar pattern, i.e. the dot areas generally increase or decrease in roughly the same proportion for each element type when the printer/colour is changed. Embodiments of the invention make use of this similarity by correcting the laser intensity required for a particular element type and then applying a proportional correction to the other types of print element.

Figure 5:
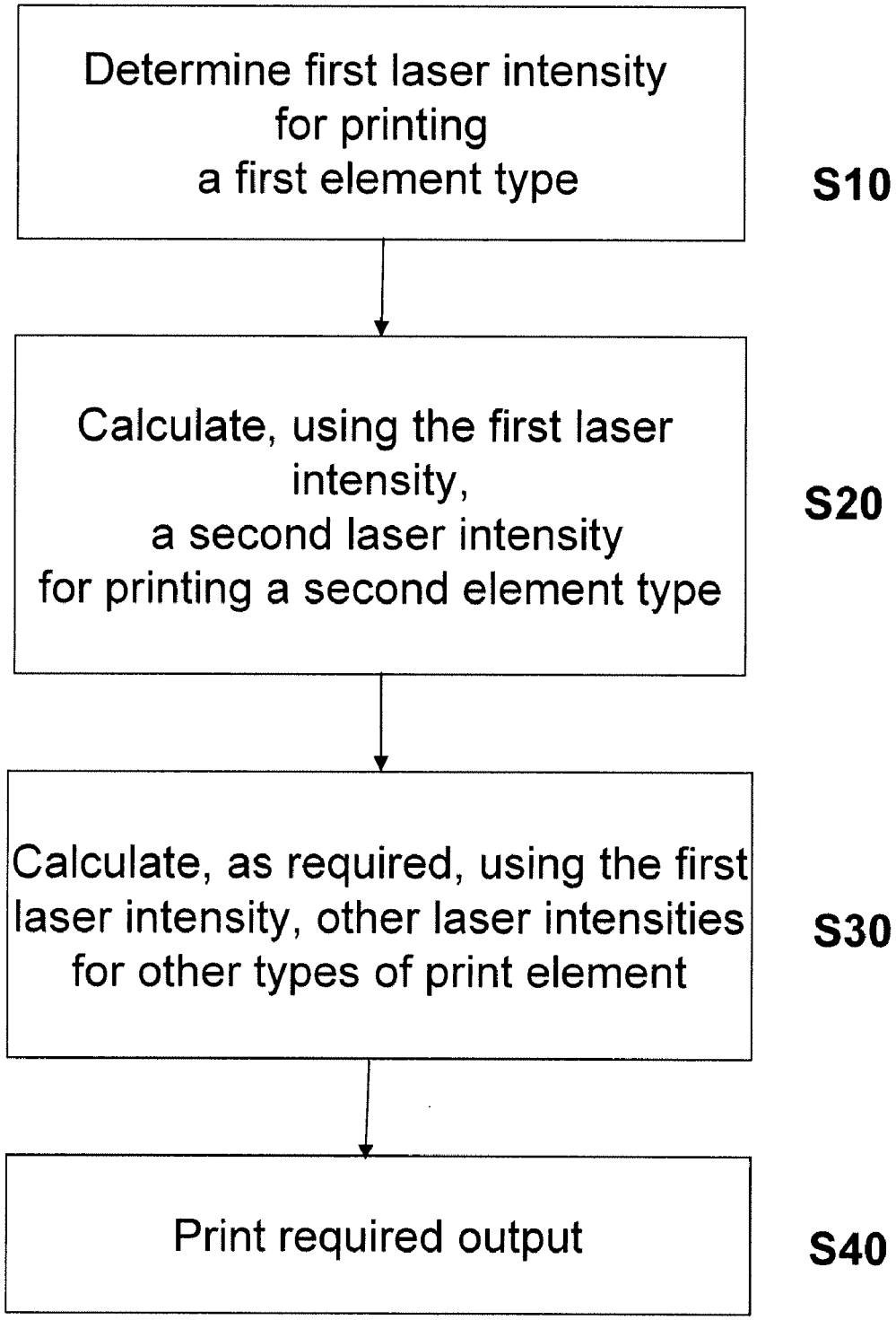
FIG. 5 is a flow diagram illustrating a process according to an embodiment of the invention.

FIG. 5 is a flow diagram illustrating processing according to an embodiment of the invention. Not all of the steps illustrated are necessarily required for all embodiments of the invention. At step S10 a first laser intensity is determined for a first type of print element, that is the laser intensity is calibrated for that print element (as will be discussed in more detail with respect to FIG. 6). At step S20 the first laser intensity is used to calculate the laser intensity required for printing a second, different type of print element.

At step S30, if required, the laser power of other types of print elements may be calibrated in a process similar to S20. That is, for example, the laser power of a third print element type may be derived using the first laser intensity. In one particular embodiment the operating laser intensities of all required print element types may be calculated from a single calibration performed for a single print element. In other embodiments more than one type of print element can be calibrated with the laser intensity required for these other print elements being derived from one or more of the calibrated laser intensities.

At step S40, once the laser powers have been calibrated the printer can be operated so as to produce printed output at the required quality. In some embodiments step S40 is not present, i.e. these embodiments relate to merely calibrating the printer so that the printer is ready for use. In one example process steps S10-S30 may be performed and the calibrated laser intensities stored (eg in a look-up table) for future use.

Figure 6:
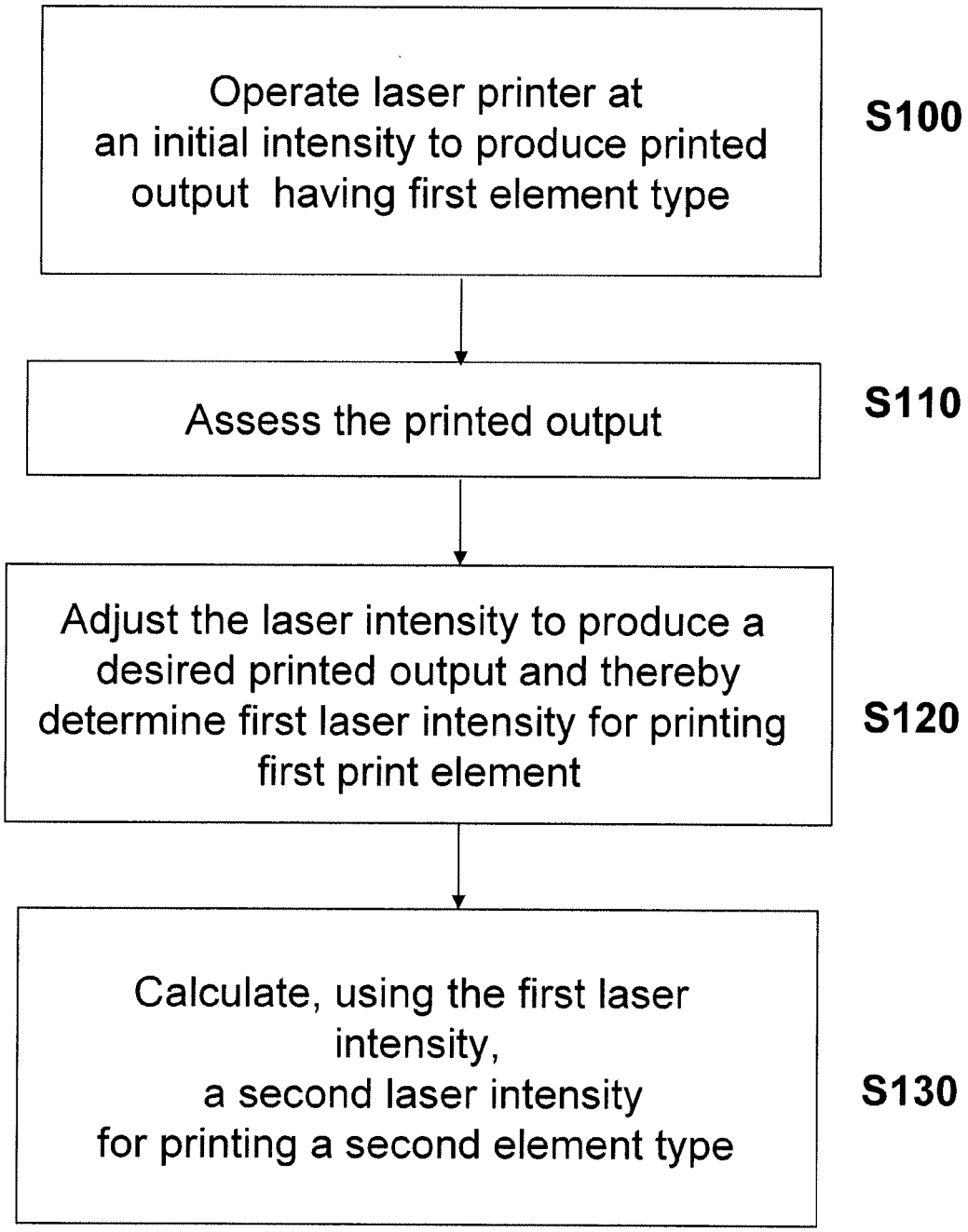
FIG. 6 is a flow diagram illustrating a process according to an embodiment of the invention.

FIG. 6 is a flow diagram that illustrates a method of operation of a printer according to an embodiment of the invention. Not all of the steps illustrated are necessarily required for all embodiments of the invention.

At step S100 the printer is operated at an initial laser intensity to produce printed output having a first type of print element. For example the printer may print a single dot element or, say, a print element for a particular halftone tone.

At step S110 the printed output is assessed. The assessment may be made by the aided or unaided human eye and in some cases the assessment is a qualitative assessment of the quality of the print out. In other cases the dot area of the printed output is assessed or measured. The assessment step may be automated so that, for example, a sensor measures a parameter of the printed output.

Figure 7:
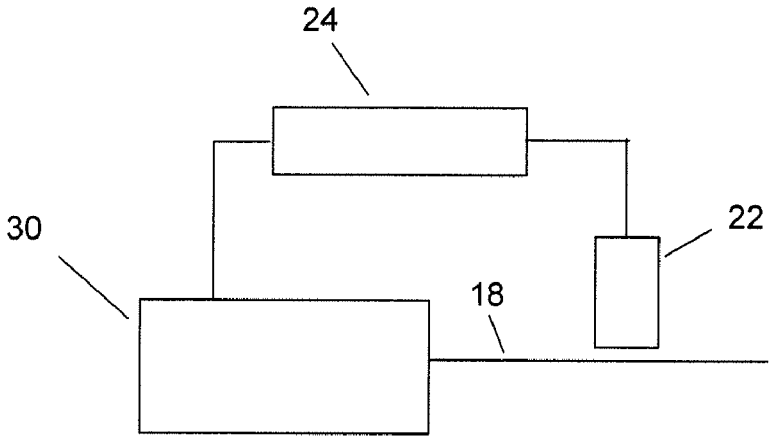
FIG. 7 is a schematic representation of a printing system according to an embodiment of the invention.

FIG. 7 illustrates a system that uses a sensor 22 for examining the print on the print medium 18. The measurements made by the sensor 18 can be provided to a control unit/processing unit 24 that can be used to control the laser intensity of the printer 30. The parameter may be the dot area or may be some other parameter that is related to dot area, such as optical density (for example) that could be measured with a densitometer. In FIG. 7 the sensor 22 and control unit/processing unit 24 are shown separately and external to the printer 30 and connected thereto. The sensor 22 and/or the control unit/processing unit 24 could also form an integral part of the printer 30.

Referring again to FIG. 6, at step S120 the laser intensity is adjusted so as to produce the first print element type at a required quality. The required quality can be characterised in terms of, for example, dot area or optical density. In some embodiments once a printed output has been produced (step S100) and assessed (step S110) the laser intensity required to produce the required print standard, (i.e. the "first laser intensity" referred to in FIG. 6) is extrapolated using the initial laser intensity without re-assessing the printed output produced by the adjusted laser intensity. In other embodiments the printer may be operated again to print the first element type at the new, adjusted, laser intensity and the printed output can again be assessed. In this way the process of printing and assessing the printed output may form a process loop that operates until the printed output reaches an acceptable standard.

According to some embodiments of the invention, the combination of steps S100, S110 and S120 can be taken as a way of performing step S110 illustrated in FIG. 5. Step 130 of FIG. 6 can be taken to be equivalent of step S20 of FIG. 5 and the discussion herein of Step 20 also applies to step 30.

It should be appreciated that embodiments of the invention described and/or claimed in a particular category should also be taken to be disclosed in other categories. For example it should be appreciated that embodiments of the invention disclosed as methods can be realised as printers configured to perform such methods and vice versa.

The invention claimed is:

1. A method of calibrating an electrophotographic printer, the printer configured with a plurality of light settings, each light setting arranged to produce a different element type, the method comprising:

determining a first light level required to print a first element type by applying a proportional change to a first initial light setting; and determining a second light level required to print a second element type by applying substantially the same proportional change to a second initial light setting.

2. The method of claim 1 wherein the step of determining the first light level comprises:

operating the printer at an initial light setting to produce printed output;

assessing the printed output;

adjusting the light setting by an adjustment factor to produce a desired printed output and thereby determining said first light level.

3. The method of claim 2 wherein said assessing comprising measuring the dot area of the printed output or other property that is dependent on the dot area of the printed output.

4. The method of claim 2 comprising:

operating the printer to print the first element at a light setting under a first set of print conditions;

applying the adjustment factor to the light setting so as to achieve printing of the first element at a required dot area; and storing said adjustment factor.

5. The method of claim 1 comprising printing to produce a printed output having a plurality of different element types, wherein two or more of the element types are printed at a light levels calculated using said proportional change.

6. A method of printing comprising calibrating a printer according to claim 1 and printing with said calibrated printer.

7. A laser printer comprising a laser and a processing unit for calibrating the source of the laser for printing a plurality of different print elements according to claim 1.

8. The method of claim 1, wherein the determining comprises determining the second light level required to print the second element type by applying to the second initial light setting the same proportional change that is applied to the first initial light setting.

9. The method of claim 1, wherein the first and second element types correspond to different respective print elements selected from: single pixels; pixels that form part of a text edge; pixels that form part of a barcode; and pixels that form part of a halftone image.

10. The method of claim 1, wherein the first and second initial light settings correspond to different laser intensity levels.

11. An electrophotographic printer comprising a light source for producing printed output, the printed output containing a first print element type, a sensor for measuring a print parameter of the printed output, a controller for controlling the optical output of the light source, the controller being configured to make an adjustment to the optical output of the light source in accordance with measurements made by the sensor to achieve a desired dot area for the first print element type wherein the controller is arranged to use said adjustment to correct the optical output of the light source to print other types of print element.

* * * * *